United States Patent [19]

Hays

[11] 4,112,636

[45] Sep. 12, 1978

[54] WALLBOARD LAMINATING CLIP

[76] Inventor: Joseph C. Hays, 340 Woodbridge Ave., Buffalo, N.Y. 14214

[21] Appl. No.: 558,310

[22] Filed: Mar. 14, 1975

[51] Int. Cl.[2] ..... E04B 1/38

[52] U.S. Cl. ..... 52/98; 52/355; 52/359; 52/434; 52/489; 52/713

[58] Field of Search ..... 52/98, 100, 760, 489, 52/713–715, 434, 354, 355, 359, 357, 358, 360, 361–363, 441, 447

[56] References Cited

U.S. PATENT DOCUMENTS

| | | | |
|---|---|---|---|
| 998,293 | 7/1911 | Jackson | 52/355 |
| 2,375,409 | 5/1945 | Glitsch | 52/489 |
| 2,661,769 | 12/1953 | Butler et al. | 52/489 X |
| 2,855,640 | 10/1958 | Rolen | 52/714 X |
| 3,047,985 | 8/1962 | Murphy | 52/363 X |
| 3,300,934 | 1/1967 | Waizenhofer | 52/489 X |
| 3,363,373 | 1/1968 | Huss | 52/98 |
| 3,553,915 | 1/1971 | Passovoy | 52/489 X |
| 3,559,358 | 2/1971 | Lohse et al. | 52/714 X |
| 3,588,082 | 6/1971 | Chiffoleau et al. | 52/489 |
| 3,605,367 | 9/1971 | Crawley | 52/714 X |
| 3,606,414 | 9/1971 | Haley | 52/489 X |
| 3,788,026 | 1/1974 | Cook | 52/98 |

FOREIGN PATENT DOCUMENTS

| | | | |
|---|---|---|---|
| 564,026 | 12/1923 | France | 52/360 |
| 341,876 | 10/1921 | Fed. Rep. of Germany | 52/714 |
| 605,238 | 5/1960 | Italy | 52/715 |
| 493,571 | 10/1938 | United Kingdom | 52/354 |
| 617,797 | 2/1949 | United Kingdom | 52/760 |
| 990,421 | 4/1965 | United Kingdom | 52/715 |
| 622,156 | 4/1949 | United Kingdom | 52/760 |
| 751,439 | 6/1956 | United Kingdom | 52/361 |
| 588,498 | 5/1947 | United Kingdom | 52/489 |

OTHER PUBLICATIONS

"Top-Side" fasteners 6/12/52 H & B Enterprise Corporation, 12 pages.

*Primary Examiner*—Leslie Braun
*Attorney, Agent, or Firm*—Joseph P. Gastel

[57] ABSTRACT

A laminating clip for temporarily holding adjacent wallboards having first and second sides against a base member with said first sides facing toward the base member including a first portion for attachment to the base member, a second portion attached to the first portion for extending through the seam between the wallboards and beyond the second sides, a retaining member mountable on the second portion for holding said wallboards against the base member while adhesive between said first sides and said base member sets, and a weakened portion between the first and second portions concealed by the second sides, which permits the second portion to be severed from the first portion by manipulating the second portion lengthwise of the seam to remove the second portion from the first portion to thereby remove all visible portions of the clip. A stud stiffener portion may be formed with the first portion of the clip to stiffen the leg of a metal stud in the event the latter constitutes the base member.

33 Claims, 23 Drawing Figures

WALLBOARD LAMINATING CLIP

The present invention relates to an improved clip for temporarily holding wallboard members against a stud while adhesive therebetween sets.

By way of background, in the past wallboards have been attached to metal studs by means of retainer strips and battens. The retainer strip is a strip which is screwed to the stud with the wallboards therebetween, and thereafter a batten is attached to the strip to hide the screw heads. In addition, various other types of retainer strips were used. The use of retainer strips increased the cost of installing wallboard by an amount of between about 8¢to 15¢a square foot, at current prices. In addition to the objectionable additional cost, the retainer strips visually interfered with the planar surface of the wall. In addition to retainer strips and battens, other types of clips were used to secure wallboards to studs. However, they were deficient in that certain portions of the clips remained exposed after the wallboards were secured to the studs, and this was objectionable. It is with overcoming the foregoing deficiencies of the prior types of wallboard retaining constructions that the present invention is concerned.

It is accordingly one important object of the present invention to provide an improved wallboard retaining clip which includes a portion which is severable from the remainder of the clip after the wallboard has been adhesively secured to a stud so that no portion of the clip remains visible.

Another object of the present invention is to provide an improved wallboard laminating clip which stiffens the metal stud with which it is associated to thereby insure that the stud does not deflect during the process of attaching wallboards thereto so that the wallboards lie evenly with each other.

A further object of the present invention is to provide an improved wallboard laminating construction which can be mounted quickly and easily on a base member and which will retain wallboards securely in position until the adhesive associated with the wallboards sets.

Yet another object of the present invention is to provide an improved wallboard laminating clip construction which can be fabricated simply and economically and which will reduce the labor costs of installing wallboards. Other objects and attendant advantages of the present invention will readily be perceived hereafter.

The present invention relates to a laminating clip for temporarily holding adjacent planar members having first and second sides relative to a base member with said first sides facing toward said base member comprising first means for attachment to said base member, second means for positioning between said planar members, means on said second means for supporting a retaining member adapted to be placed in retaining engagement with said second sides of said planar members, and separable means connecting said first means and said second means to permit said second means to be removed from said first means after said planar members have been secured relative to said base member by permanent attaching means. In accordance with another aspect of the present invention, the laminating clip includes a stiffener portion for bracing the leg of a metal stud so as to prevent it from deflecting excessively during the process of adhesively securing the planar member to the stud. The various aspects of the present invention will be more fully understood when the following portions of the specification are read in conjunction with the accompanying drawings wherein:

FIG. 9 is a side elevational view similar to FIG. 7 but taken from the opposite side of the clip from which FIG. 7 is taken;

Figure 3:
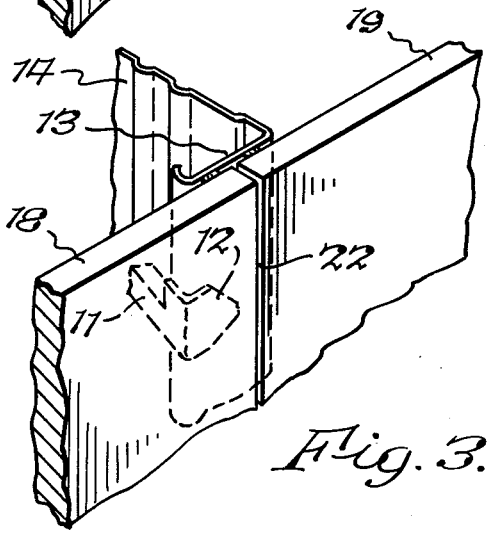
FIG. 3 is a fragmentary perspective view similar to FIG. 2 but showing the portion of the laminating clip which remains after the exposed portion is broken therefrom.

The combined stud stiffener and laminating clip 10 of FIGS. 1-9 is fabricated from sheet metal and includes a stud stiffener portion 11, an attachment portion 12 for attaching member 10 to a base member, namely, leg 13 of U-shaped metal stud 14, and a retainer supporting portion 15 secured to attachment portion 12 by means of a weakened portion 16. As explained briefly above, the purpose of clip 10, in association with retaining member or retainer 17, is to hold wallboards 18 and 19 against leg 13 of stud 14 until such time as the adhesive beads 20 and 21 (FIG. 4) set, after which retaining member 17 is removed and retainer supporting portion 15 is severed by bending it back and forth in line with seam 22 between wallboards 18 and 19 so that no portion of clip 10 is visible at seam 22, as shown in FIG. 3.

Figure 1:
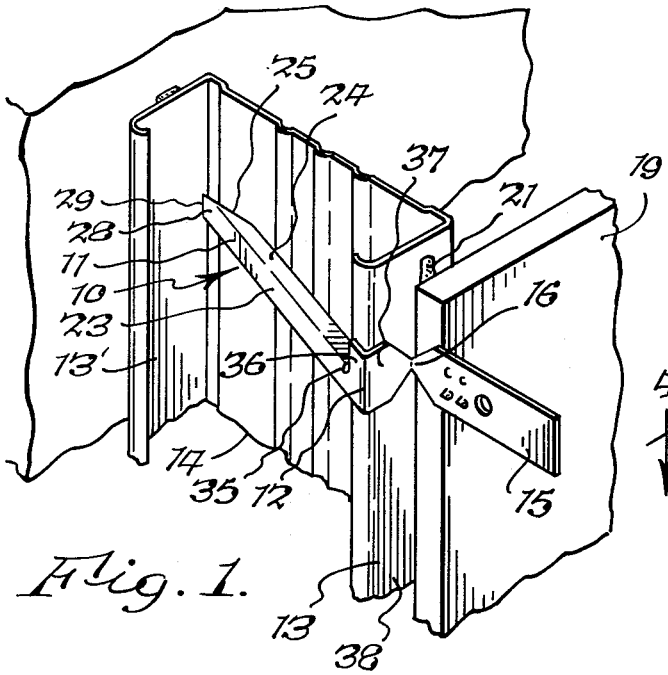
FIG. 1 is a fragmentary perspective view of a combined laminating clip and stud stiffener in place on a metal stud.
Figure 2:
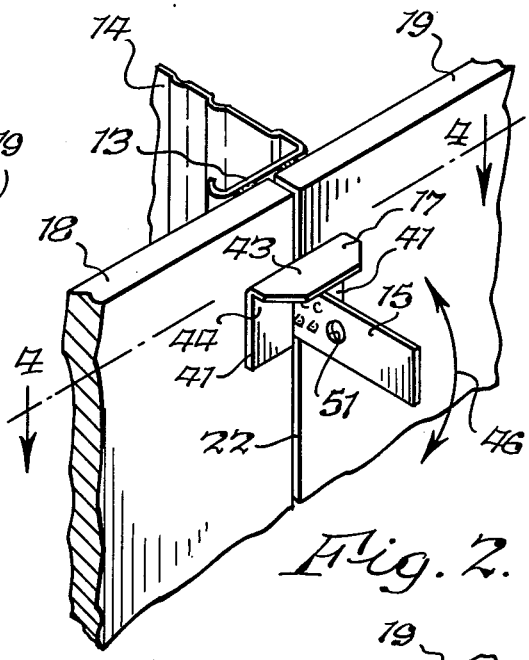
FIG. 2 is a fragmentary perspective view similar to FIG. 1 and showing a retaining member mounted on the laminating clip for holding a pair of wallboards in end-to-end abutting relationship with respect to each other and against the leg of the metal stud.
Figure 4:
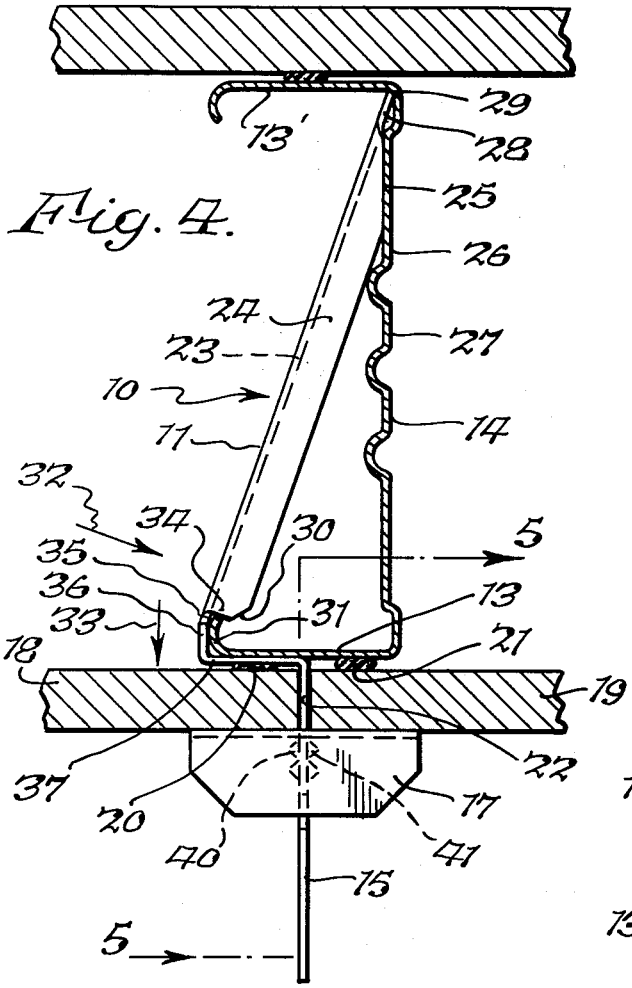
FIG. 4 is a fragmentary cross sectional view taken substantially along line 4—4 of FIG. 2.
Figure 5:
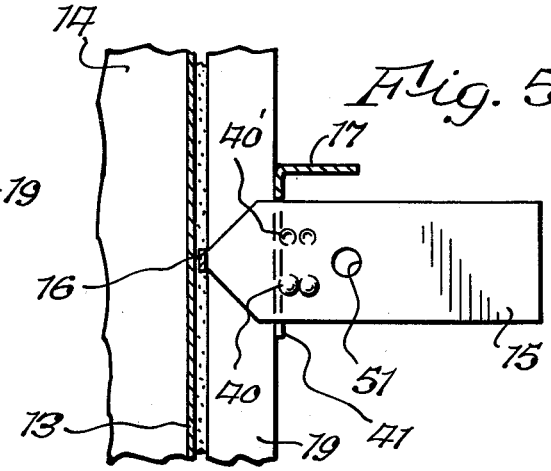
FIG. 5 is a fragmentary cross sectional view taken substantially across line 5—5 of FIG. 4.
Figure 6:
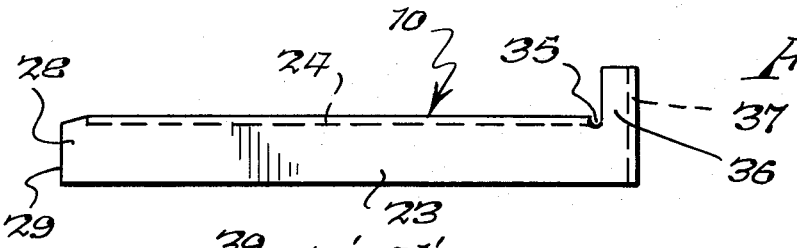
FIG. 6 is a side elevational view of the combined laminating clip and stud stiffener shown in FIGS. 1-5.

In its more specific aspects combined laminating clip and stud stiffener 10 is fabricated from sheet metal, although it is possible that other materials such as suitable plastics may be used. The stud stiffener portion 11 is formed into an angle having legs 23 and 24. The end of leg 24 is severed at an angle at 25 so that it fits firmly against portion 26 of base 27 of metal stud 14 (FIG. 4). The end portion 28 of leg 23 extends beyond surface 25 and the extreme end 29 bears against leg 13' which is the mirror image of leg 13 (FIGS. 1 and 4). The opposite end of leg 24 includes an inclined camming surface 30 which engages the outer end of lip 31 when leg 11 is moved in the direction of arrow 32 after end 29 has been placed against leg 13' in the position shown in FIG. 4. Camming surface 30 will cause leg 13 to deflect outwardly in the direction of arrow 33 until such time as camming portion 30 passes beyond lip 31, at which time the natural resilience of leg 13 will cause it to assume the position shown in FIG. 4 wherein the outer edge of lip 31 bears against end 34 of leg 24 to hold clip 10 in position. End 34 is considered a part of clip attachment portion 12 because it aids in securing the clip to leg 13. Leg 23 includes a small slot 35 at the end of leg 23 to enhance the ease with which a bend may be produced in attachment portion 12 to cause clip 10 to lie in contiguous abutting relationship with the outer end of stud leg 13, as can be seen from FIG. 4. The attachment portion 12 is formed in the shape of an angle having one side 36 which lies against lip 31 and an adjacent side 37 which lies against the outer face 38 of leg 13.

Figure 7:
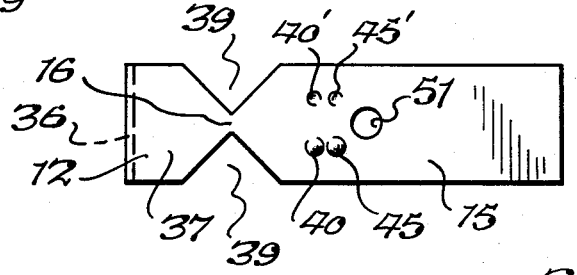
FIG. 7 is an end elevational view of the combined laminating clip and stud stiffener taken from the right of FIG. 6.
Figure 8:
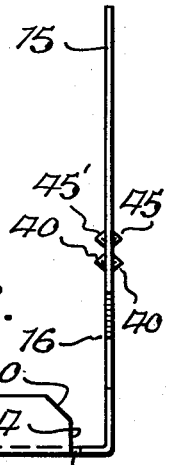
FIG. 8 is a plan view of the combined laminating clip and stud stiffener.
Figure 9:
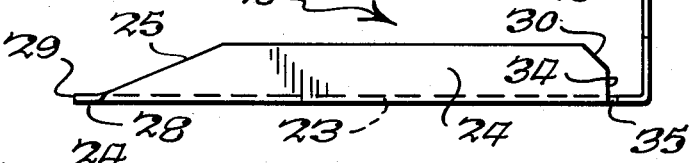

The retainer supporting portion 15 is substantially planar and is attached to attachment portion 12 at weakened portion 16 which is produced by cutting out two triangular portions 39 from the sheet material (FIG. 7). After clip 10 has been mounted on a stud, portion 15 is bent relative to portion 12 so that it lies substantially perpendicularly to portion 37 (FIGS. 1 and 4), and it is approximately in line with the middle of leg 13. Thereafter, wallboards 18 and 19 are held in position after adhesive beads 20 and 21 have been spread along surface 38 of leg 13. Thereafter, a retainer 17 is mounted on retainer supporting portion 15 to hold wallboards 18 and 19 in position until the adhesive beads set.

Figure 10:
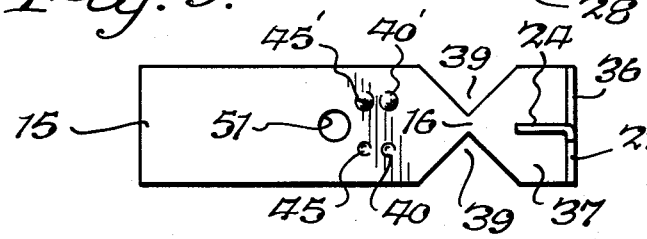
FIG. 10 is a side elevational view of the retaining member shown in FIGS. 2, 4 and 5.
Figure 11:
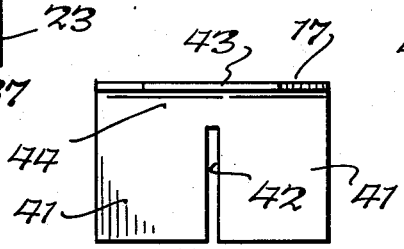
FIG. 11 is an end elevational view of the retaining member of FIG. 10.

Retainer supporting portion 15 includes a first pair of oppositely extending dimples 40 and 40'. Retainer 17 includes legs 41 with a slot 42 therebetween (FIG. 10). A tab 43 extends substantially perpendicularly to portion 44 in which legs 41 are formed. By sliding slot 42 over the part of portion 15 between dimples 40—40' and the outer surfaces of wallboards 18 and 19, a wedge-fit will be provided which holds the wallboards in position. Retainer 17 is forced into position by applying digital pressure to tab 43.

It is to be noted at this point that the foregoing procedure is followed with a number of laminating clips 10 which are mounted along the length of stud 14, possibly at intervals of between 1 and 2 feet. It will be noted that there is a second pair of dimples 45—45' spaced from the first pair. Dimples 45—45' are used to support retainer 17 when thicker wallboards are used. In this respect, dimples 40–40' are intended for use with ½ inch wallboard and dimples 45—45' are intended for use with ⅝ inch wallboard because dimples 45—45' are spaced ⅛ inch from dimples 40—40'.

After the adhesive 20–21 has set, retainer 17 is removed by engaging the underside of tab 17 and pulling upwardly. Thereafter retainer supporting portion 15 is moved back and forth in the plane of seam 22 in the direction of arrows 46 until such time as weakened portion 16 breaks. Thereafter, portion 15 is pulled out of seam 22 and discarded so as to leave the wallboards 18 and 19 in position as shown in FIG. 3, without any portion of the clip visible.

Figure 12:
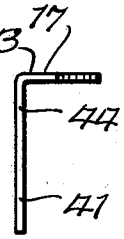
FIG. 12 is a fragmentary perspective view similar to FIG. 2 but showing an alternate form of retaining member which can be used with the laminating clip.
Figure 12:
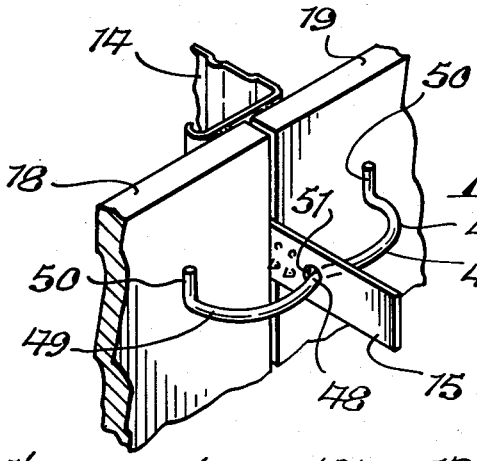

An alternate form of retainer 47 is shown in FIG. 12. This retainer is essentially a cylindrical bar which has been formed to the configuration shown with a low point 48 between arcuate legs 49 which merge into portions 50 which extend substantially perpendicularly to portions 49. Retainer 47 is threaded through aperture 51 so that portion 48 bears against the aperture 51, and legs 50 are positioned against wallboards 18 and 19 to retain them in position. After the adhesive was hardened, retainer 47 is pivoted so as to permit portion 15 to be manipulated in the direction of arrows 46 so that it can be broken from clip portion 37.

While retainer supporting portion 15 has been shown in FIGS. 1–12 with both an aperture 51 and pairs of dimples 40—40' and 45—45', it will be appreciated that the dimples may be eliminated if only a retainer such as 47 is intended to be used. Alternatively, aperture 51 may be eliminated if only the dimples 40—40' and 45—45' are intended to be used with a clip 17. In addition, if desired, either set of dimples 40—40' or 45—45' may be eliminated if the clip is intended to be used with only one thickness of wallboard.

The stud stiffener portion 11 described in detail above serves the function of preventing the outer end of leg 13 from yielding when wallboard 18 is pressed against it. It will be appreciated that if this were to occur after the adhesive has set, the wallboard 19 would extend further outwardly than wallboard 18. In other words, their outer surfaces would not lie in the same plane. The stud stiffener portion 11 prevents the foregoing deficiency by holding the outer portion of leg 13 as rigidly as the inner portion is held by the base 27 of metal stud 14.

Figure 13:
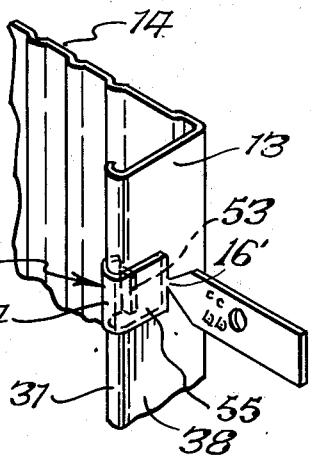
FIG. 13 is a fragmentary perspective view of an alternate form of laminating clip which attaches to the leg of a metal stud but does not have a stud stiffener associated therewith.
Figure 14:
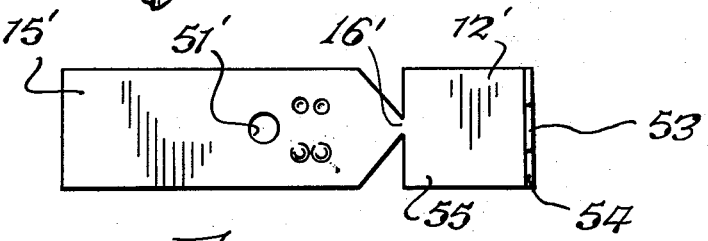
FIG. 14 is a side elevational view of a blank which forms the clip of FIG. 13.
Figure 15:
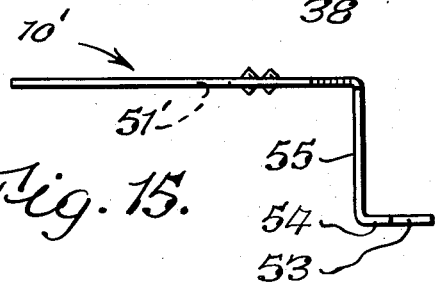
FIG. 15 is a plan view of the clip of FIG. 13 before attachment to the leg of a metal stud.

In FIGS 13, 14 and 15 another form of laminating clip is shown. This form is generally similar to that shown in FIGS. 1–11 except that it does not possess the stiffener 11. Clip 10' is attached to leg 13 by bending tab 53 around lip 31 by means of pliers or the like. Portion 54 will lie against the outer side of lip 31 and portion 55 will lie against face 38 of leg 13. Essentially portions 54–55 are equivalent to portions 36–37 of FIGS. 1–9. As can be seen from FIGS. 14 and 15, portions 54–55 comprise an attachment portion 12' and they lie in perpendicular planes. A weakened portion 16' is provided at the junction of portions 12' and 15' and this portion is analogous to portion 16 of FIGS. 1–9. An aperture 51' is shown in portion 15' for the purpose of receiving a retainer such as 47. Dimples such as 40—40' and 45—45' are also shown.

Figure 16:
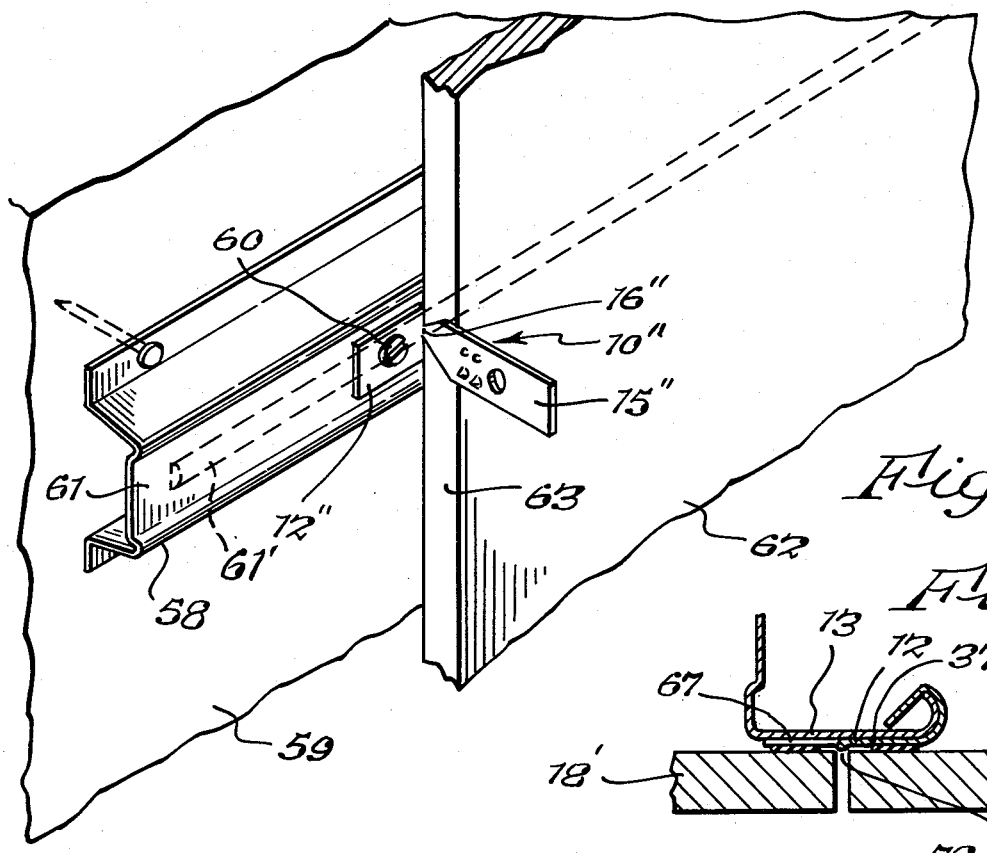
FIG. 16 is a fragmentary perspective view showing a still further form of laminating clip which is adapted to be attached to a furring channel strip.

In FIG. 16 a modified type of clip 10" is shown for use with furring strips such as 58 which are mounted on a wall 59. Clip 10" includes an attachment portion 12"

having an aperture (not shown) therein for receiving a sheet metal screw 60 which attaches it to planar portion 61 of furring strip 58. A retainer supporting portion 15'' is secured to portion 12'' by means of a weakened portion 16''. Portion 15'' may have the various dimples or the retainer supporting aperture described above with respect to the other embodiments.

In the use of clip 10'', a wallboard 62 is placed in position along the plurality of furring strips, such as 58, which are mounted in parallel spaced relationship on wall 59. Thereafter, a clip 10'' is placed in position on each furring strip with the side of portion 15'' of each clip against edge 63 and each clip is screwed in position by means of a screw 60. Thereafter, another wallboard, not shown, is placed with its edge in abutting relationship to edge 63 after suitable adhesive 61' has been applied to the furring strips. Thereafter, retainers such as 17 or 47 are placed on the various protruding retainer supporting portions 15'' to hold the wallboards in position. After the adhesive sets, the retainers are removed, and portions 15' are broken from portions 12' as described in detail above to leave only a seam without any clip portion protruding therefrom. Furring strips 61 may be mounted on wall 59 either horizontally, as shown, or vertically.

Figure 19:
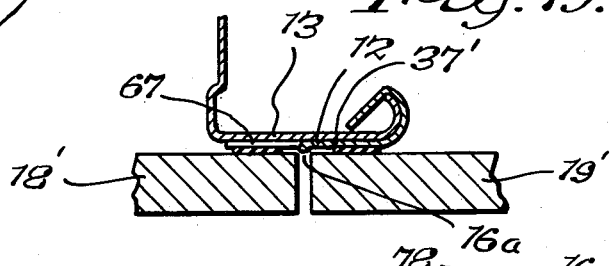
FIG. 19 is a fragmentary cross sectional view taken substantially along line 19—19 of FIG. 18.
Figure 17:
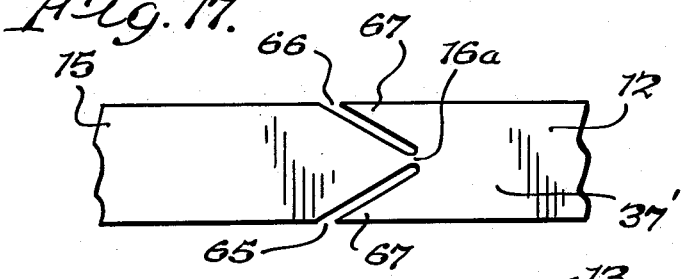
FIG. 17 is a side elevational view showing a modified construction of a weakened portion of the laminating clip which permits adjacent wallboards to bear equally on the clip.
Figure 18:
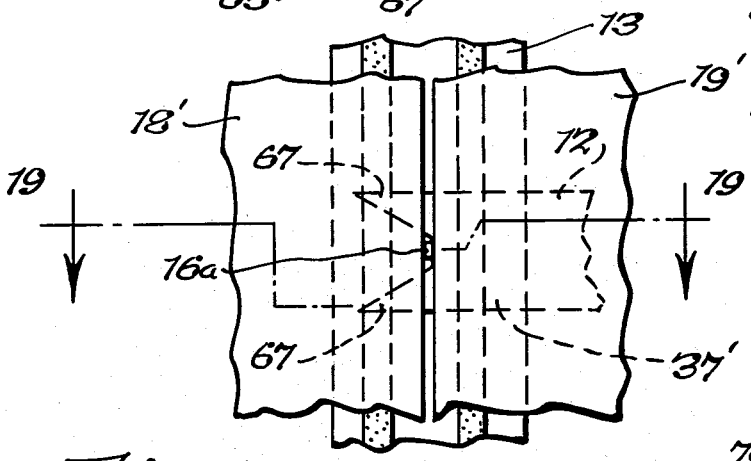
FIG. 18 is a side elevational view showing the relationship between a stud, the clip of FIG. 17, and the wallboards positioned against the stud after the retainer supporting portion has been broken off.

In FIGS. 17–19 a modified weakened portion **16*a* is shown which can be positioned between any of the attachment portions and retainer supporting portions designated by the family numerals 12 and 15, respectively. The weakened portion 16*a* is formed by providing two inclined slots 65 and 66 between attachment portion 12 and retainer-supporting portion 15. When portion 12 is placed on leg 13 and portion 15 is bent at right angles thereto, there will be a portion 37' which underlies wallboard 19' and triangular portions 67 which underlie wallboard 18'(FIG. 18). It can thus be seen that there is a thickness of clip which underlies both edges of the adjacent wallboards. The advantage of this is two-fold. First of all, it tends to eliminate any unevenness in the surfaces of the adjacent wallboards, that is, it causes the surfaces to lie in the same plane whereas in the embodiment such as shown in FIG. 4, it is possible that one wallboard might lie closer to the surface 38 of leg 13 than the other. Furthermore, the various portions 37' and 67, by spacing the wallboards away from leg 13, will insure that a minimum amount of adhesive remains between the contiguous surfaces of leg 13 and wallboards 18' and 19'. In other words, it prevents all of the adhesive from being squeezed away if one of the boards should be pressed too tightly against leg 13. It will be appreciated that the construction of the weakened portion 16*a*-65-66 shown in FIGS. 17–19 may be incorporated in any of the previous embodiments of the present invention instead of the weakened portions, such as 16, 16' or 16''** which were shown.

Figure 20:
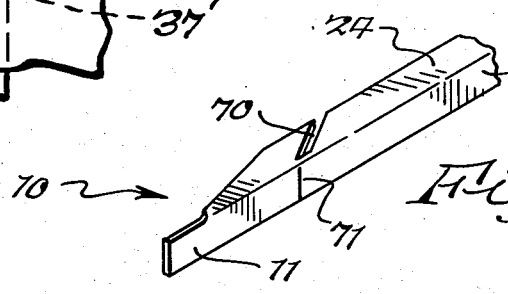
FIG. 20 shows a modified form of stiffener for the embodiment of FIG. 1.

Clip 10 of FIG. 1 may be fabricated in a modified form, as shown in FIG. 20, to fit a plurality of sizes of channels. In this respect, leg 24 of stiffener portion 11 may have a slot 70 therein and leg 23 may have an embossment 71 therein. If it is desired to use clip 10 with a stud 14 which is 2½ inches wide, rather than 3⅝ inches wide, as shown, it is merely necessary to bend the outer end portion of stiffener 11 around embossment 71 until it breaks off, whereupon the remainder of stiffener portion 11 will be of a proper length to fit a 2½ inch stud. It will be appreciated that elements 70–71 may be optionally formed in stiffener 11 during fabrication, if desired. Preferably, however, clip 10 should be fabricated without elements 70–71, but with stiffener 11 of the proper length to fit a particular size stud. Except for elements 70–71, the clip 10 of FIG. 20 is identical to the clip 10 of FIG. 1.

Figure 21:
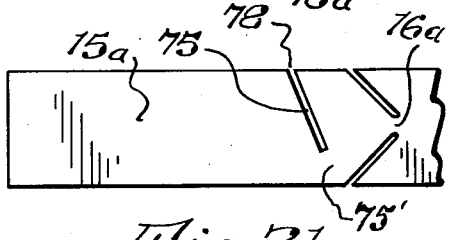
FIG. 21 is a fragmentary side elevational view of a modified construction of the retaining clip for receiving a modified retainer.
Figure 22:
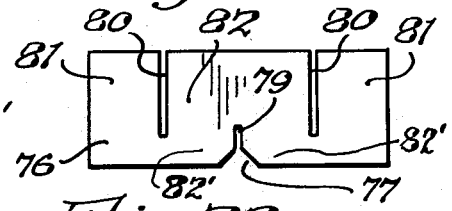
FIG. 22 is a side elevational view of the retainer for use with the construction of FIG. 21.
Figure 23:
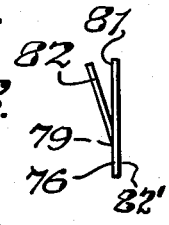
FIG. 23 is an end elevational view of the retainer of FIG. 22.

A modified retainer supporting portion **15*a* is shown in FIG. 21 for use with a modified retainer 76 (FIGS. 22 and 23). The retainer supporting portion may be substituted for any of the retainer supporting portions of the preceding embodiments of the invention, such as shown in FIGS. 1–9, 13–15 or 16. Retainer supporting portion 15*a* differs from all the other disclosed retainer supporting portions in that it possesses a slot 75 which is inclined downwardly toward the wallboards. A retainer 76 is selectively inserted into slot 75 and presses against the wallboards to hold them in place. More specifically, retainer 76, which is fabricated from planar sheet metal, includes a notched portion 77 which is inserted into the top 78 of slot 75. Notch 77 merges into slot 79 which rides in slot 75 until portion 75' enters slot 79, portion 75' being below and in line with slot 75. Slots 80 in retainer 76 are equidistantly spaced on opposite sides of slot 79 so as to cause the end portions 81 of retainer 76 to be in the form of tabs. Central portion 82 of retainer 76, which is located between slots 80, is bent rearwardly relative to tabs 81 (FIG. 23) while portions 82' below portion 82 remain in substantially the same plane with tabs 81. Therefore, all parts of retainer 76 lie in the same plane except central portion 82. Since central portion 82 extends at an angle relative to tabs 81, the tabs will be parallel to a wallboard when central portion 82 is received in slot 75. Therefore the faces of tabs 81 will bear against the wallboards to firmly press against them. It will be appreciated that the amount of force with which tabs 81 press against the wallboards is determined by the force with which retainer 76 is pressed into slot 75. It is the frictional engagement between the wallboards and tabs 81 which will hold retainer 76 in position until such time as it is removed from slot 75. Because slot 75 is inclined, the retainer supporting construction can be used with different thicknesses of wallboard. In this respect, when used with ½ inch wallboard, retainer 76 will reach a lower position in slot 75 than when used with ⅝ inch wallboard. After retainer 76 has been removed, the reduced portion 16*a* is severed, as described in detail above relative to the embodiment of FIG. 17**.

While the clip of the present invention has been described relative to holding wallboards against a stud, it will be appreciated that it can be used in any application wherein members are to be held against a base member.

It can thus be seen that the improved wallboard laminating clips of the present invention are manifestly capable of achieving the above-enumerated objects and while preferred embodiments of the present invention have been disclosed, it will be appreciated that the present invention is not limited thereto but may be otherwise embodied within the scope of the following claims.

What is claimed is:

1. A laminating clip for temporarily holding adjacent planar members having first and second sides in end-to-end relationship with a seam therebetween relative to a base member with said first sides facing toward said base member comprising attachment portion means for permanent attachment to said base member, first portion means including side means for lying flat against said base member, said first portion means having first and second ends with said first end formed integrally with said attachment portion means, second portion means for extending substantially perpendicularly to said side means and for extending through said seam between said planar members, said second portion means having first and second ends with said first end of said second portion means being formed integrally with said second end of said first portion means, retaining member supporting means on said second portion means for supporting retaining member means in retaining engagement with said second sides of said planar members, and severable means connecting said first end of said second portion means to said second end of said first portion means to permit said second portion means to be severed from said first portion means after said planar members have been secured relative to said base member by permanent attaching means, said severable means being located on said clip for positioning between said base member and said second sides.

2. A laminating clip as set forth in claim 1 including retaining member means for mounting on said second portion means for pressing against said second sides.

3. A laminating clip as set forth in claim 2 wherein said retaining member supporting means on said second portion means comprises deformed portions, and wherein said retaining member means comprises a slotted wedge for mounting between said second sides and said deformed portions.

4. A laminating clip as set forth in claim 2 wherein said retaining member supporting means on said second portion means comprises an aperture, and wherein said retaining member means comprises a bar for insertion into said aperture and pressing against said second sides.

5. A laminating clip as set forth in claim 1 wherein said clip is fabricated from planar sheet material, and wherein said severable means comprises a portion of reduced size which can be fractured by manipulating said second portion means.

6. A laminating clip as set forth in claim 5 wherein said attachment means comprises means for attachment to the leg of a metal stud.

7. A laminating clip as set forth in claim 6 wherein said attachment means comprises a tab which is secured to said leg.

8. A laminating clip as set forth in claim 6 including stiffener means for stiffening said leg of said stud against deflection by said planar members.

9. A laminating clip as set forth in claim 8 wherein said stiffener means comprises an elongate rigid strut having one end attached to said attachment means and its opposite end adapted to bear against a portion of said stud spaced from said leg.

10. A laminating clip as set forth in claim 5 wherein said attachment portion means comprises a planar portion, and means on said planar portion to permit it to be screwed to a furring strip.

11. A laminating clip as set forth in claim 5 wherein said portion of reduced size is located at an area where opposed triangular pieces have been cut out from said strip material.

12. A laminating clip as set forth in claim 5 wherein said portion of reduced size is located at an area wherein opposed elongated slots extending inwardly from the outer edges of said strip material are formed at an angle to the longitudinal axis of said strip material so as to cause said first portion to bear against said first sides of both of said adjacent planar members.

13. A laminating clip as set forth in claim 1 wherein said retaining member supporting means on said second means comprises slot means extending toward said second sides, and wherein said retaining member means comprises plate means for insertion into said slot means, and pressing means on said plate means for pressing against said second sides.

14. A laminating clip as set forth in claim 13 wherein said pressing means comprises tab means.

15. A laminating clip as set forth in claim 14 wherein said tab means are formed by portions of said plate means which are partially separated from the remainder of said retaining member means by slots in said retaining member means.

16. A laminating clip as set forth in claim 1 wherein said severable means are located at the junction of said side means and said second portion means.

17. A laminating clip for temporarily holding adjacent planar members having first and second sides relative to the leg of a metal U-shaped stud having parallel legs with said first sides facing toward one of said legs comprising an elongated brace member having first and second ends with said first end for bearing against a portion of said stud remote from said leg, a first planar portion having first and second ends and being adapted to be positioned on said leg, an attaching portion located proximate said first end of said first planar portion and proximate said second end of said brace member for attaching said clip to said leg, a weakened portion located proximate said second end of said first planar portion and adapted to be positioned between the edges of said leg, a second elongated planar portion having first and second ends with said first end located proximate said weakened portion and adapted to extend substantially perpendicularly to said first portion and between said planar members and outwardly beyond said second sides of said planar members, retainer supporting means on said second portion for supporting a retainer adapted to bear against said second sides of said planar members to hold said first sides of said planar members against said leg, said second end of said second portion being manipulatable for severing said second portion from said first portion at said weakened portion.

18. A laminating clip as set forth in claim 17 wherein said retainer supporting means are dimples.

19. A laminating clip as set forth in claim 18 including retaining means comprising a slotted plate-like member adapted to be inserted between said dimples and said second sides of said planar members.

20. A laminating clip as set forth in claim 17 wherein said retainer supporting means is an aperture.

21. A laminating clip as set forth in claim 20 including retaining means comprising a bar which is received in said aperture and bears against said second sides of said planar members.

22. A laminating clip as set forth in claim 17 wherein said weakened portion is formed by opposed cutouts between said first and second portions.

23. A laminating clip as set forth in claim 22 wherein the cutouts are triangular.

24. A laminating clip as set forth in claim 22 wherein said cutouts are inclined slots extending inwardly from opposite sides of said clip at the junction of said first and second portions.

25. A laminating clip as set forth in claim 17 wherein said elongated brace member is formed in the shape of an angle.

26. A laminating clip as set forth in claim 17 wherein said retainer supporting means comprises slot means.

27. A laminating clip as set forth in claim 26 including retaining means comprising plate means for insertion into said slot means, and pressing means on said plate means for pressing against said second sides.

28. A laminating clip as set forth in claim 27 wherein said slot means comprises a slot which is inclined toward said second sides, and wherein said pressing means comprises tab means.

29. A laminating clip as set forth in claim 28 wherein said tab means are partially separated from the remainder of said retainer by slots in said retainer.

30. A laminating clip as set forth in claim 27 wherein said weakened portion is formed by opposed cutouts between said first and second portions.

31. A laminating clip as set forth in claim 30 wherein said cutouts are inclined slots extending inwardly from opposite sides of said clip at the junction of said first and second portions.

32. A laminating clip as set forth in claim 17 including shortening means on said brace member for shortening the length of said brace member.

33. A laminating clip as set forth in claim 32 wherein said shortening means comprises a slot in said brace member.

* * * * *